US006802328B2

(12) United States Patent
Lin

(10) Patent No.: US 6,802,328 B2
(45) Date of Patent: Oct. 12, 2004

(54) ADJUSTABLE CANOPY OF A SWING SET

(75) Inventor: Steve Lin, Chia I Hsien (TW)

(73) Assignee: Compex International Co., Ltd., Chia I Hsien (TW)

( * ) Notice: Subject to any disclaimer, the term of this patent is extended or adjusted under 35 U.S.C. 154(b) by 232 days.

(21) Appl. No.: 10/265,601

(22) Filed: Oct. 8, 2002

(65) Prior Publication Data

US 2004/0065360 A1 Apr. 8, 2004

(51) Int. Cl.[7] ..... A63G 9/12

(52) U.S. Cl. ..... 135/96; 135/121; 135/117; 403/53; 403/56; 248/252.12; 472/118

(58) Field of Search ..... 135/88.01, 88.02, 135/88.03, 88.04, 90, 96, 121, 161, 117, 120.3; 297/184.1, 184.15, 273; 472/118, 119, 120, 121, 122, 123, 124, 125; 403/83, 84, 85, 87, 93, 94, 95, 96; 248/252.12, 183.4

(56) References Cited

U.S. PATENT DOCUMENTS 4,785,190 A * 11/1988 Frankena ..... 250/503.1
5,039,118 A * 8/1991 Huang ..... 280/47.371
5,190,390 A * 3/1993 Ming-Tai ..... 403/24
5,765,958 A * 6/1998 Lan ..... 403/97
6,383,085 B1 * 5/2002 Tseng ..... 472/118
6,629,801 B2 * 10/2003 Cheng ..... 403/101

FOREIGN PATENT DOCUMENTS

WO WO 95/26151 * 10/1995

* cited by examiner

*Primary Examiner*—Janet M. Wilkens
(74) *Attorney, Agent, or Firm*—Rosenberg, Klein & Lee

(57) ABSTRACT

An adjustment device of an adjustable canopy of a swing set includes a fixed part, an engaging part, and an adjustable part. The fixed part is joined to the frame of a swing set, and has locating hooks. The engaging part is securely connected to the fixed part, and has engaging protrusions on an outer side, which have convexly curved surfaces, and plasticity. The adjustable part, to which a covering part of the canopy is connected, has concavely curved sections spaced around an annular inner side. The locating hooks are connected to the adjustable part such that the adjustable part can turn relative to the fixed part. The concavely curved portions contact the convexly curved protrusions. The inner side of the adjustable part depresses the convexly curved protrusions when force is exerted on the adjustable part so that the canopy covering part can be adjusted.

5 Claims, 7 Drawing Sheets

ADJUSTABLE CANOPY OF A SWING SET

BACKGROUND OF THE INVENTION

1. Field of the Invention

The present invention relates to an adjustable canopy of a swing set, more particularly an adjustable canopy of a mobile swing set, which is relatively uncomplicated in structure, easy to assemble, and safe to use.

2. Brief Description of the Prior Art

Mobile swing sets can be moved, and are usually provided with canopies on the tops so that people playing the swings can be protected from hot sun. However, early canopies of swing sets are fixedly disposed on the tops of the frames of the canopy sets, and cannot be adjusted in position according to the position of the sun. Consequently, such canopies cannot protect the users of the swings from hot sun effectively all the time.

To overcome the above disadvantage, an adjustable canopy is provided to a swing set. Referring to FIG. 1, the adjustable canopy includes a fixed part 10, an adjustable part 20, a fixing element 30, a canopy support (not numbered), a covering part (not shown), and an elastic member 40. The fixed part 10 has a lower connecting portion 101, and an upper connecting portion 102, which is formed with a central through hole 104, and an annular toothed portion 103 around the central through hole 104. The adjustable part 20 has a main body 201, and a connecting portion 204 projecting from a top of the main body 201; the main body 201 has a central through hole 203, and an annular toothed portion 202 around the central through hole 203.

The fixed part 10 is fixedly joined to a top of the frame of a swing set at the lower connecting portion 101. The adjustable part 20 is joined to the fixed part 10 with the toothed portion 202 facing the toothed portion 103, and with the fixing element 30 being passed through the through hole 203 and screwed into the through hole 104; the elastic member 40 is disposed between the parts 10, and 20. The canopy support is fixedly joined to the connecting portion 204 of the adjustable part 20, on which the covering part is supported. Thus, the toothed portions 202, and 103 usually engage each other for the adjustable part 20 to be kept in position.

To adjust the part 20, the fixing element 30 is turned to move back from the fixed part 10 so that the toothed portion 202 disengages the toothed portion 103. Then, the adjustable part 20 is pivoted on the fixing element 30 to a new position, and the fixing element 30 is tightly screwed into the hole 104 of the fixed part 10 again after the adjustment.

Therefore, the canopy can be adjusted to suitable position to block sunlight effectively. However, this adjustable canopy is found to have disadvantages as followings:

1. Having relatively many separate parts, the canopy is complicated in structure, and costs much labor to assemble.
2. The fixing element 30 has to be turned back from the through hole 104, and turned back into the through hole 104 again respectively for allowing the adjustable part 20 to be adjusted, and after adjustment the adjustable part 20. Therefore, the canopy is not very convenient to use.
3. The canopy support is prone to fall to cause injury to the users playing on the swings if the fixing element 30 is not securely connected to the fixed part 10.

SUMMARY OF THE INVENTION

It is a main object of the present invention to provide an adjustable canopy to a swing set, which has relatively uncomplicated structure, and is easy to assemble and safe to use.

The adjustment device of an adjustable canopy of a swing set includes a fixed part, an engaging part, and an adjustable part. The fixed part is joined to the frame of a swing set, and has locating hooks. The engaging part is securely connected to the fixed part, and has engaging protrusions on an outer side, which have convexly curved surfaces, and plasticity.

The adjustable part has a securing portion, to which a support of a covering part of the canopy is securely connected. The adjustable part has a main body having a first annular wall projecting from one side the main body. The first annular wall has concavely curved sections on the inner side. The adjustable part has a second annular wall shaped to have an inward engaging surface on an inner side. The locating hooks are connected to the adjustable part such that the adjustable part can turn relative to the fixed part.

In combination, the concavely curved sections contact to engage the convexly curved protrusions. The inner side of the second annular wall of the adjustable part, which has the concavely curved sections, depresses the convexly curved protrusions when external force is exerted on the adjustable part to make the same to turn so that the canopy covering part can be adjusted.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
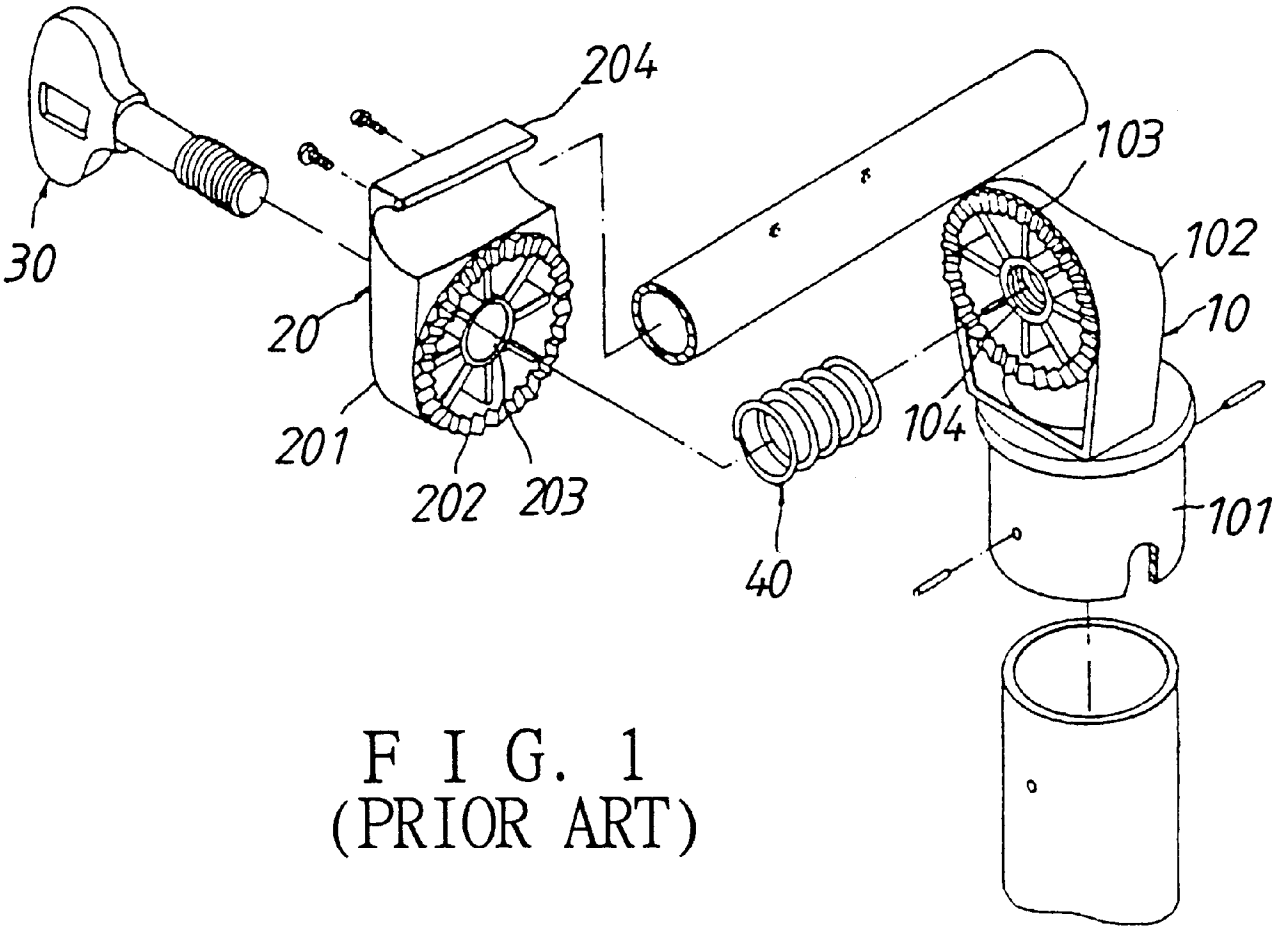
FIG. 1 (PRIOR ART)
FIG. 1 is a partial exploded perspective view of the conventional adjustable canopy of a swing set as described in the Background.
Figure 2:
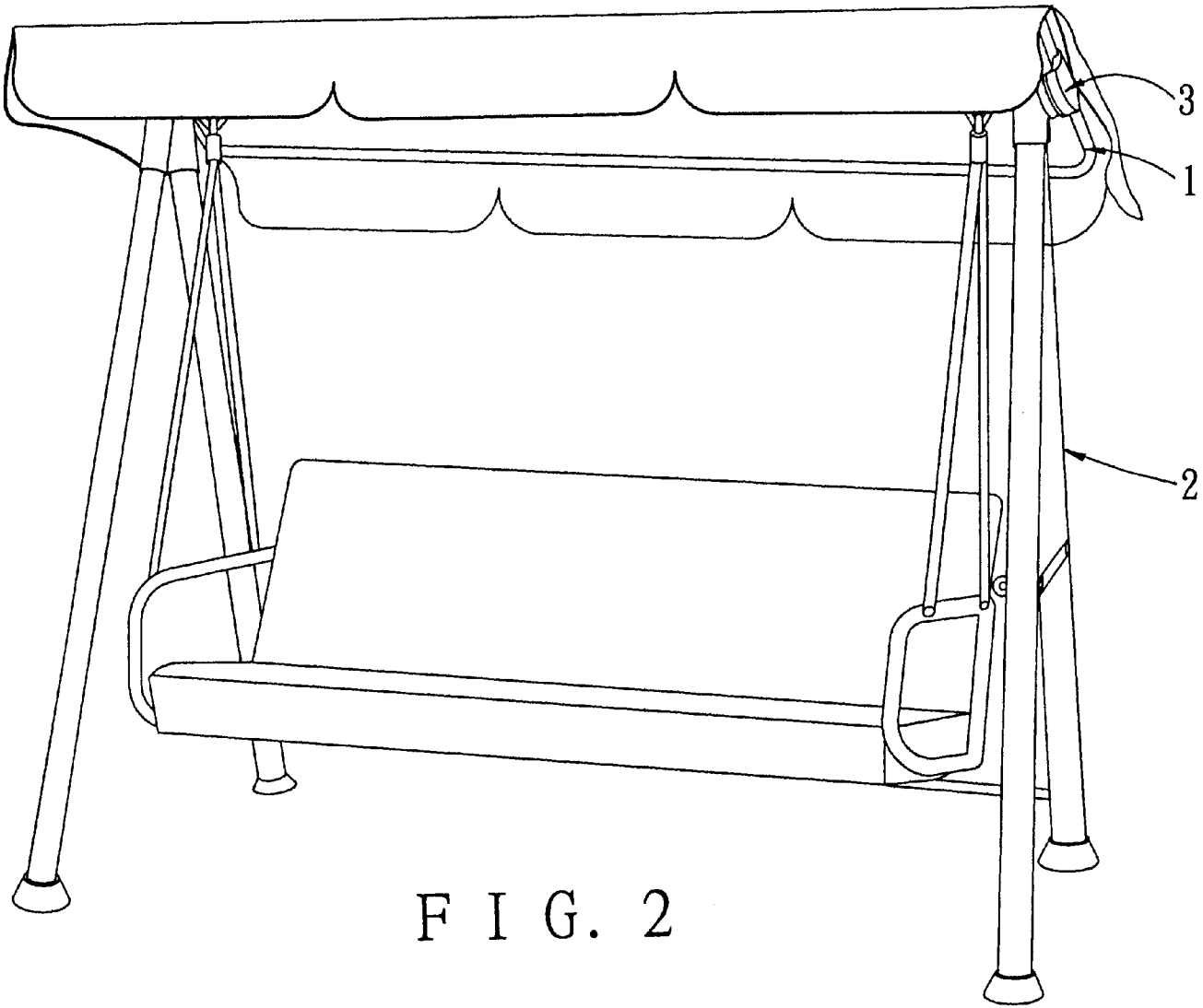
FIG. 2 is a perspective view of a swing set with the adjustable canopy according to the present invention.
Figure 3:
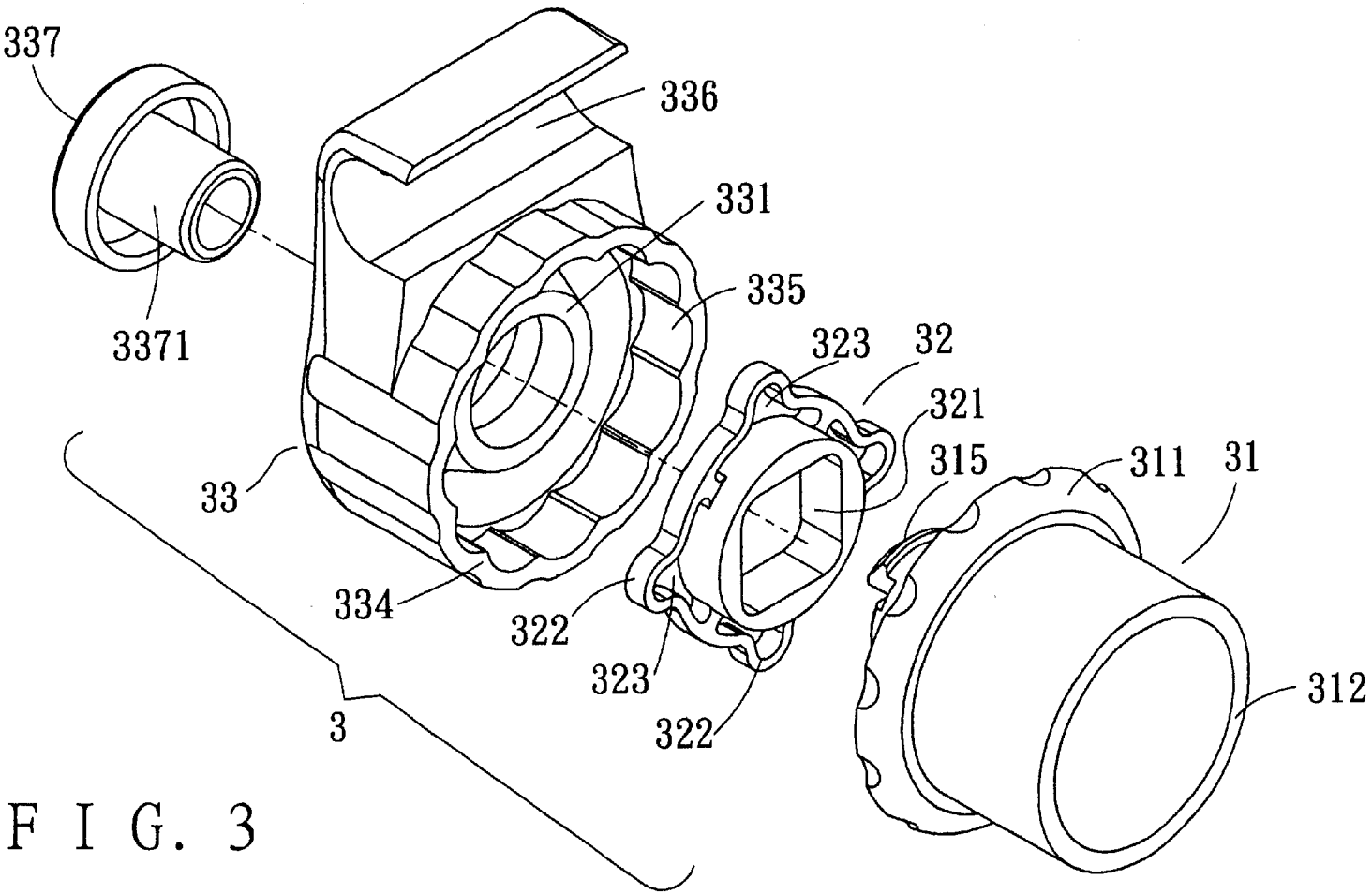
FIG. 3 is an exploded perspective view of the adjustment device of the adjustable canopy according to the present invention.

Referring to FIGS. 2, and 3, an adjustable canopy 1 is provided to a swing set, which includes a supporting frame 2, and a swing.

The adjustable canopy 1 has a covering part, and a support 11 for supporting the covering part thereon. One end of the covering part support 11 is equipped with an adjustment device 3. The adjustment device 3 includes a fixed part 31, an engaging part 32, and an adjustable part 33.

Figure 4:
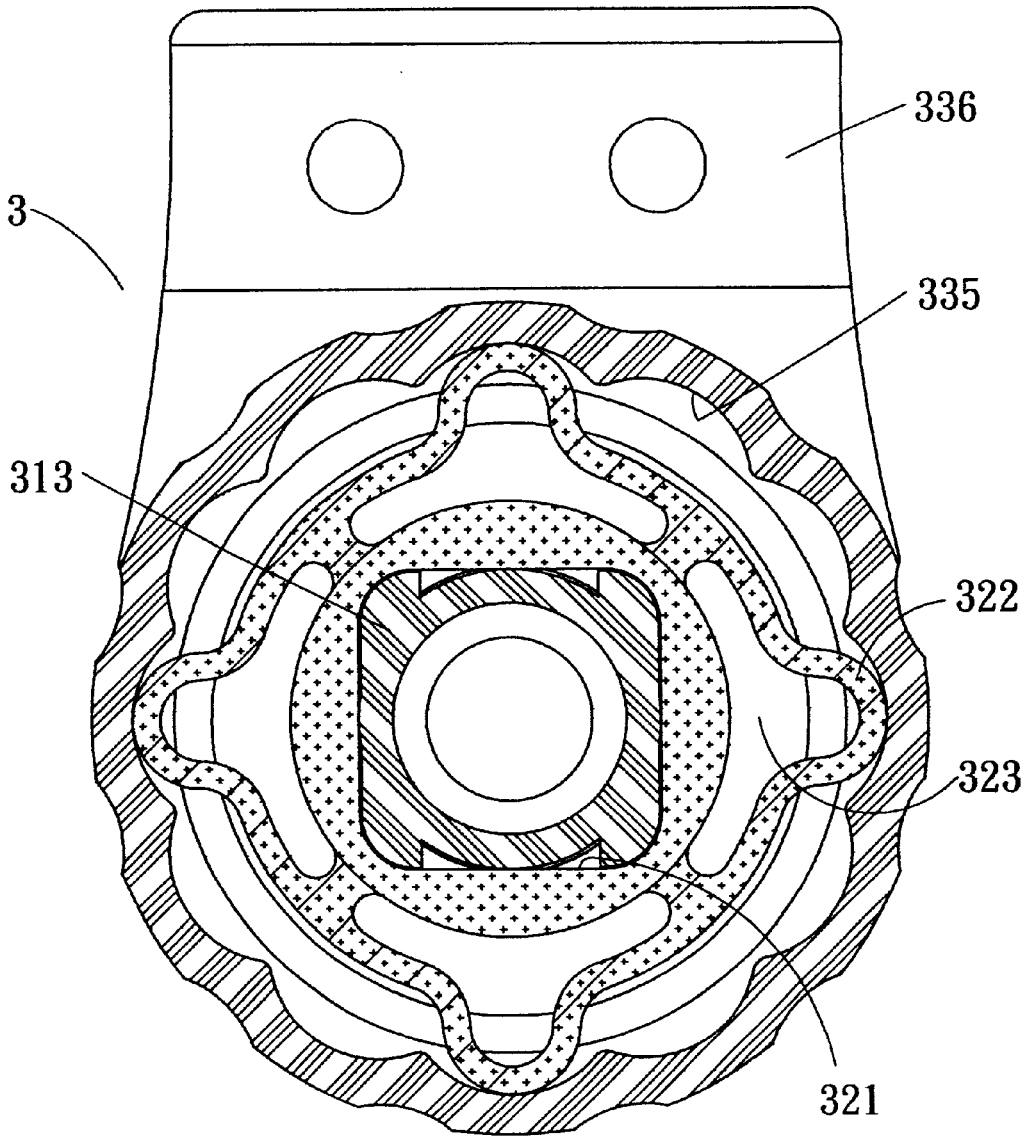
FIG. 4 is a cross-sectional view of the adjustment device of the adjustable canopy according to the present invention.
Figure 5:
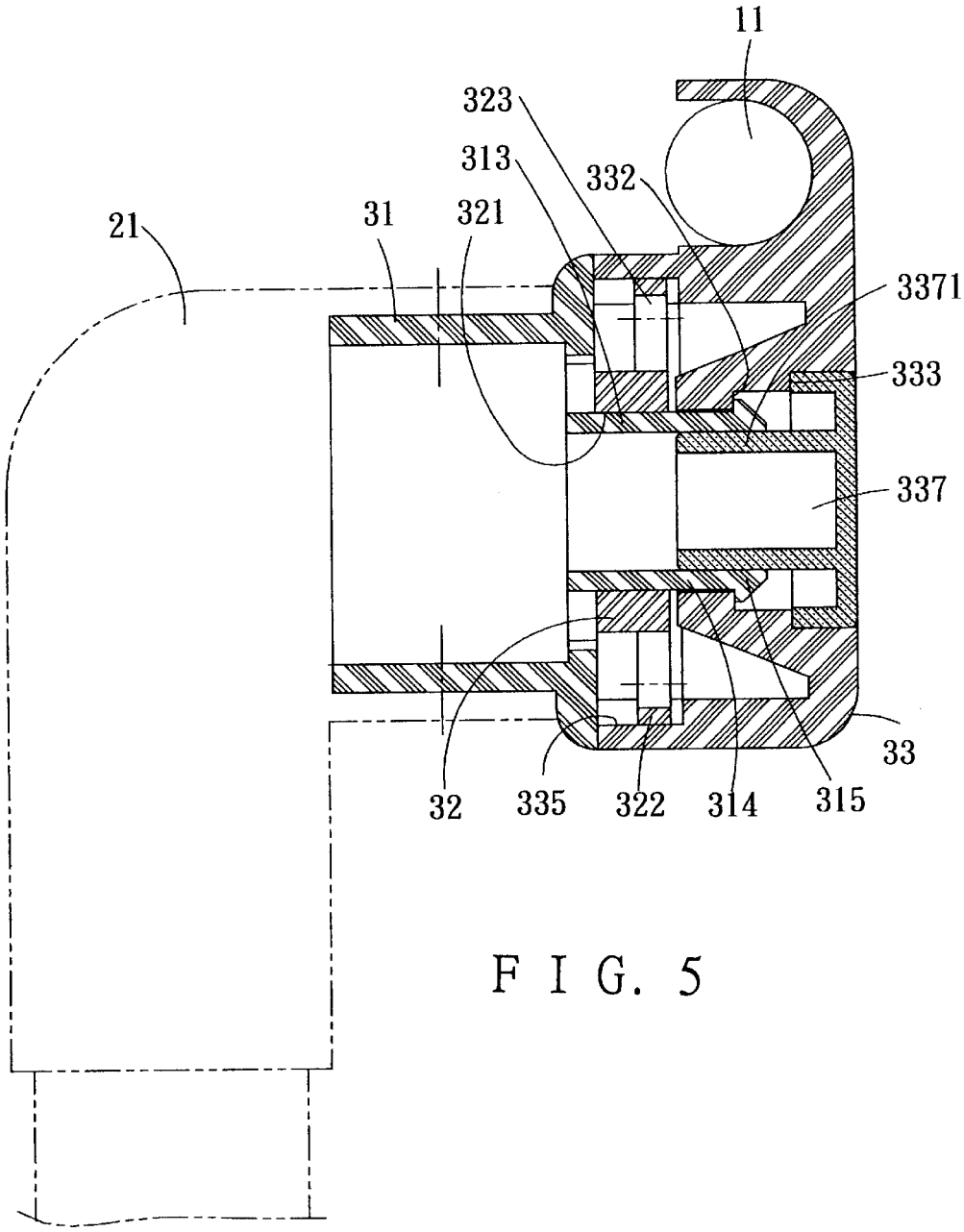
FIG. 5 is another cross-sectional view of the adjustment device of the adjustable canopy according to the present invention.
Figure 6:
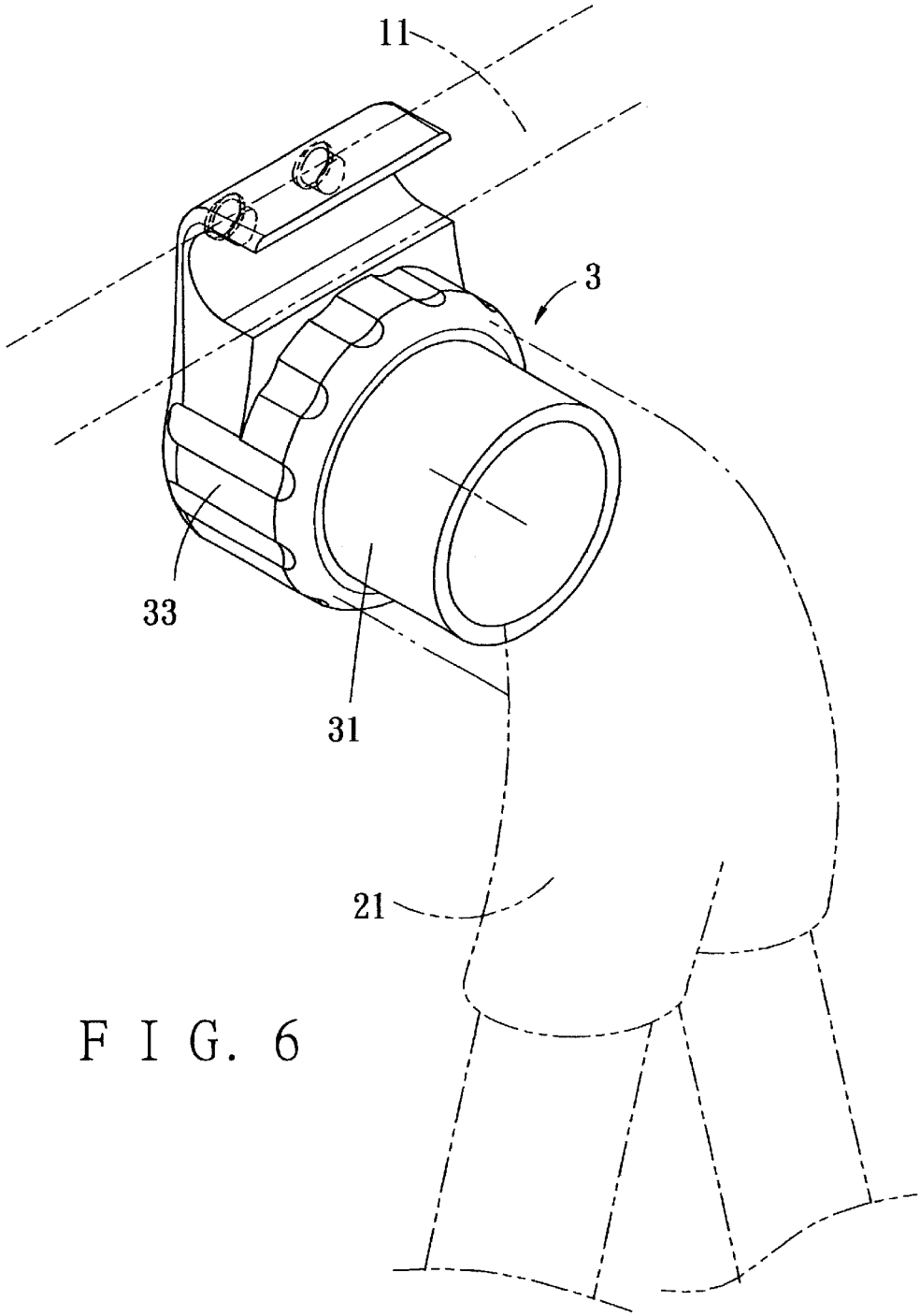
FIG. 6 is a perspective view of the adjustment device of the adjustable canopy according to the present invention; and, FIG. 7 is a view showing the adjustment device of the adjustable canopy of the present invention under adjustment.

Referring to FIGS. 4, and 5, the fixed part 31 has a stopping plate 311, a connecting portion 312 projecting from one side of the stopping plate 311, and an insertion portion 313 projecting from the other side of the stopping plate 311. The insertion portion 313 has an annular protrusion 314 sticking out from the outer end thereof and two opposite locating hooks 315 projecting from the annular protrusion 314. The insertion portion 313 is shaped such that the front view thereof has a polygonal shape. For example, the insertion portion 313 can be a square shape as shown in FIG. 4.

The engaging part 32 has a central hole 321 shaped like the insertion portion 313 of the fixed part 31. The engaging part 32 has several engaging protrusions 322 formed around an outer side thereof. Each of the engaging protrusions 322 has a convexly curved surface, and is provided with a through hole 323 in order to have plasticity.

The adjustable part 33 has a main body, and a securing portion 336 projecting from the main body. The adjustable part 33 has a first annular wall 334, which is formed to have several concavely curved sections 335 arranged around an inner side thereof. The adjustable part 33 has a hollow connecting portion 331 at a central portion of the other side of the main body.

The hollow connecting portion 331 of the adjustable part 33 has an inward engaging surface, which includes a first annular section near to the fixed part a second annular section adjacent to the first annular section, and a third annular section adjacent to the second annular section; the second annular section has a bigger diameter than the first one so that a first stair shaped engaging portion 332 (FIG. 5) is formed; the third annular section has a bigger diameter than the second one so that a second stair shaped engaging portion 333 (FIG. 5) is formed.

In combination, the support 11 of the covering part is fixedly connected to the securing portion 336 of the adjustable part 33. And, the fixed part 31 is securely joined to an upper end 21 of the supporting frame 2 of the swing set at the connecting portion 312 as shown in FIG. 5. The engaging part 32 is tightly mounted around the polygonal insertion portion 313 of the fixed part 31 from the central hole 321 thereof so that the engaging part 32 can't be turned relative to the fixed part 31. Then, the adjustable part 33 is joined to the fixed part 31 with the locating hooks 315 of the fixed part 31 being passed through the hollow connecting portion 331 thereof to engage the first stair shaped engaging portion 332, and with the concavely curved sections 335 being mounted onto, and engaged with, the convexly curved engaging protrusions 322 of the engaging part 32; a plug 337 is inserted into the hollow connecting portion 331 with a first thinner section 3371 thereof coming into contact with inner sides of the locating hooks 315 to prevent the locating hooks 315 from disengaging the first stair shaped engaging portion 332 so that the adjustable part 33 is stopped from falling off the fixed part 31, the locating hooks 315 being not capable of stopping the adjustable part 33 from turning. A thicker section of the plug 337 is disposed within the third annular section of the hollow connecting portion 331.

Figure 7:
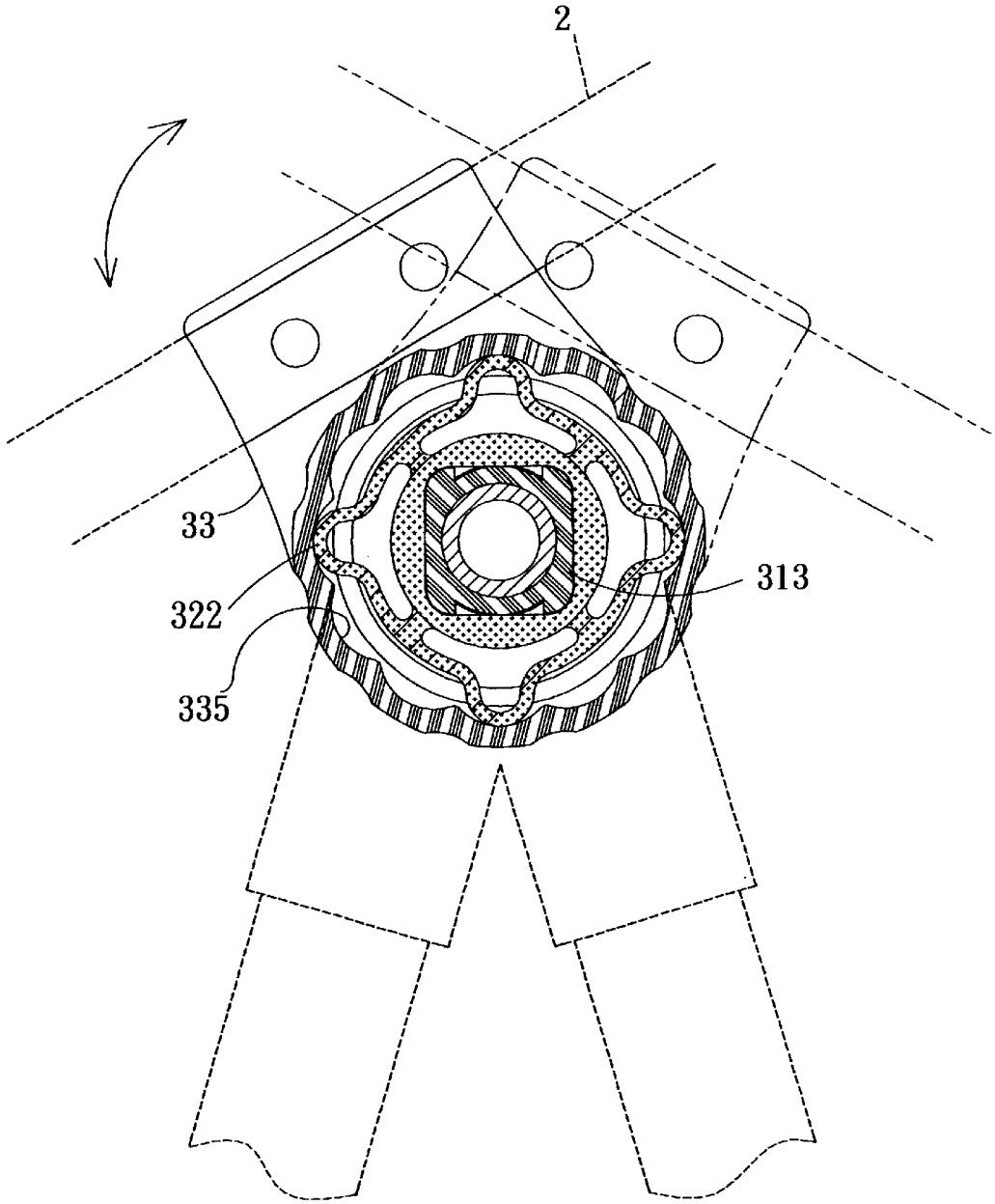

To adjust the canopy, referring to FIG. 7, external force is exerted on the support 11 of the covering part so that the inner side of the first annular wall 334 of the adjustable part 33 depresses the convexly curved engaging protrusions 322 having plasticity to allow the adjustable part 33 to be turned relative to the fixed part 31; thus, the covering part of the canopy is adjusted in position together with the support 11 thereof. The convexly curved engaging protrusions 322 of the engaging part 32 engage the concavely curved sections 322 of the adjustable part 20 to hold the adjustable part 20 in position when external force for the adjustment disappears.

From the above description, it can be easily understood that the adjustment device of an adjustable canopy according to the present invention has advantages as followings:

1. Consisting of relatively few parts (a fixed part, an engaging part, an adjustable part), the adjustment device has relatively uncomplicated structure, and costs less labor and time to assemble as compared to the conventional one.
2. The canopy covering part can be moved to a new position by means of moving the adjustable part 33 of the adjustment advice together with the support thereof directly. Therefore, the canopy adjustment device is very convenient to use.
3. The adjustable part 33 is joined to the fixed part 31 with the locating hooks 315 of the fixed part 31 being passed through the hollow connecting portion 324 thereof to engage the first stair shaped engaging portion 332 therein, therefore the adjustment device can be assembled easily without use of other fixing elements such as bolts.
4. The adjustable part 33 can't fall off the fixed part 31 due to the engagement of the convexly curved engaging protrusions with the first stair shaped engaging portion 332 thereof, therefore the canopy with the present adjustment device is safe to use.

What is claimed is:

1. An adjustment device of an adjustable canopy of a swing set, comprising a fixed part fixedly joined to a top of a supporting frame of a swing set; the fixed part having a hollow polygonal insertion portion projecting from a first side thereof; the insertion portion having a plurality of locating hooks projecting therefrom;

an engaging part having a central polygonal hole tightly mounted on the polygonal insertion portion of the fixed part; the engaging part having a plurality of engaging protrusions formed around an outer side thereof; each of the engaging protrusions having a convexly curved surface; each of the engaging protrusions being provided with plasticity;

an adjustable part having a securing portion, to which a support of a covering member is securely connected; the adjustable part having a main body having a first annular wall projecting from one side the main body; the first annular wall having a plurality of concavely curved sections arranged around an inner side thereof; the adjustable part having a hollow connecting portion at a middle of other side of the main body; the hollow connecting portion having a second annular wall shaped to have an inward engaging surface;

the adjustable part being joined to the fixed part with the locating hooks of the fixed part being passed through the hollow connecting portion thereof to engage the engaging surface of the hollow connecting portion, and with the concavely curved sections being mounted onto, and engaged with, the convexly curved engaging protrusions;

the covering member being fixed in position with engagement of the convexly curved engaging protrusions of the engaging part with the inner side of the first annular wall of the adjustable part; the inner side of the first annular wall of the adjustable part depressing the convexly curved engaging protrusions to allow the adjustable part to be turned relative to the fixed part when the support of the covering member is adjusted manually.

2. The adjustment device of an adjustable canopy of a swing set as claimed in claim 1, wherein both the hollow polygonal insertion portion of the fixed part and the central polygonal hole of the engaging part are square.

3. The adjustment device of an adjustable canopy of a swing set as claimed in claim 1, wherein each of the engaging protrusions of the engaging part is formed with through hole to have plasticity.

4. The adjustment device of an adjustable canopy of a swing set as claimed in claim 1, wherein the engaging surface of the hollow connecting portion of the adjustable part has a first annular section near to the fixed part, and a second annular section adjacent to the first annular section; the second annular section having bigger diameter than the first one so that the locating hooks of the fixed part can engage the engaging surface to prevent the adjustable part from falling off the fixed part.

5. The adjustment device of an adjustable canopy of a swing set as claimed in claim 4, wherein the inward engaging surface of the hollow connecting portion of the adjustable part has a third annular section adjacent to the second annular section; the third annular section having bigger diameter than the second one; a plug being inserted into the hollow connecting portion with a first section thereof coming into contact with inner sides of the locating hooks to prevent the hooks from disengaging the inward engaging surface of the engaging part; the plug having a second section disposed within the third annular section of the inward engaging surface.

* * * * *